US007900593B2

(12) United States Patent
Hazelton et al.

(10) Patent No.: US 7,900,593 B2
(45) Date of Patent: Mar. 8, 2011

(54) THERMAL AND ACOUSTIC VALLEY SHIELD FOR ENGINE ASSEMBLY

(75) Inventors: Gary J. Hazelton, White Lake, MI (US); Iain J. Read, Warren, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 428 days.

(21) Appl. No.: 12/105,687

(22) Filed: Apr. 18, 2008

(65) Prior Publication Data

US 2009/0044930 A1 Feb. 19, 2009

Related U.S. Application Data

(60) Provisional application No. 60/956,029, filed on Aug. 15, 2007.

(51) Int. Cl.
*F02B 77/00* (2006.01)

(52) U.S. Cl. ..... 123/195 C; 181/204

(58) Field of Classification Search ..... 123/195 C, 123/54.4–54.8; 181/204
See application file for complete search history.

(56) References Cited

U.S. PATENT DOCUMENTS 3,994,129 A * 11/1976 Sakurai et al. ..... 123/184.33
5,937,804 A * 8/1999 Kaminski ..... 123/195 C

* cited by examiner

*Primary Examiner* — Noah Kamen
(74) *Attorney, Agent, or Firm* — Quinn Law Group, PLLC

(57) ABSTRACT

A valley shield operable as a noise, fluid, and heat barrier is provided for use with an engine assembly having an engine block with two cylinder banks defining an interbank valley therebetween, and two cylinder heads secured thereto. The valley shield has a unitary body including a base with two laterally spaced side portions extending angularly outward therefrom. The body is configured to pressably fit into place proximate to the valley, between the two cylinder banks, and be secured therein by the cylinder heads. The base is oriented immediately adjacent to the interbank valley and is contoured to define an air pocket therebetween. Each lateral side portion includes a flange extending laterally therefrom to directly engage with the perimeter of the interbank valley, providing an acoustic seal therebetween. The base defines two longitudinally displaced trough portions each defining drain holes and configured to allow for gravitational evacuation of fluid therefrom.

20 Claims, 2 Drawing Sheets

THERMAL AND ACOUSTIC VALLEY SHIELD FOR ENGINE ASSEMBLY

CLAIM OF PRIORITY

This application claims priority to U.S. Provisional Patent Application No. 60/956,029, filed on Aug. 15, 2007, which is hereby incorporated by reference in its entirety.

TECHNICAL FIELD

The present invention relates generally to internal combustion engines, and more particularly to thermal valley shields for V-type engine block assemblies having an interbank valley defined between the two engine cylinder banks.

BACKGROUND OF THE INVENTION

"V-type" internal combustion engine (ICE) assemblies are traditionally defined by an engine block having a pair of outwardly angled cylinder banks with inside walls that define an interbank valley therebetween. Each cylinder bank of a typical V-type over-head valve ICE defines a cylinder bore having a piston reciprocally movable therein. The piston and cylinder bore cooperate with a portion of a cylinder head to form a variable volume combustion chamber. The cylinder head defines intake ports through which air, provided by an intake manifold, is selectively introduced into the combustion chamber. Additionally, the cylinder head defines exhaust ports through which exhaust gases or products of combustion are selectively evacuated from the combustion chamber. Normally, an exhaust manifold is affixed to the cylinder head, by bolting or other fastening means, such that the exhaust manifold communicates with each exhaust port to carry the exhaust gases from the ICE to a vehicular exhaust aftertreatment system for subsequent release to the atmosphere.

In-cylinder emissions reduction devices, such as exhaust gas recirculation (EGR) systems, are also included in many current engine assemblies in order to curtail the amount of NOx and other pollutants from the exhaust gas released into the atmosphere. EGR works by recirculating a portion of an engine's exhaust gas back to the engine cylinders. Recirculation affects the engine's combustion process in three primary ways. First, there is a dilution effect caused by the reduction in the concentration of oxygen in intake air. Second, there is a thermal effect caused by increasing the specific heat capacity of each charge. Third, there is a chemical effect which results from the dissociation of CO2 and water vapor during combustion. EGR can be achieved by either recirculating some of the exhaust leaving the engine back into the engine, which is known as external EGR, or by retaining a fraction of the exhaust gas—i.e., gas never leaves the engine, which is known as internal EGR. Major exhaust gas constituents that are "recirculated" include N2, CO2, water vapor, and partially burned hydrocarbons.

Some modern ICEs employ a mechanical supercharging device such as a turbocharger, which is short for turbine driven, forced induction supercharger. Most turbochargers include a turbine portion and a compressor portion. The turbine portion has a turbine housing that is in fluid communication at an inlet end with the engine exhaust manifold. The turbine housing receives exhaust gases from the exhaust manifold, and redirects the exhaust stream to spin a turbine blade. The turbine blade is rigidly mounted to a compressor blade for unitary rotation therewith. As the compressor blade spins, ambient air is compressed within a compressor housing; the compressed air is subsequently introduced to the intake manifold to increase the volumetric efficiency of the ICE.

To maximize the performance of the turbocharger, the turbine housing is typically located as close to the exhaust port as possible so that heat energy from the flowing exhaust stream that might otherwise be used to spin the turbine blade is not wasted through radiation to the atmosphere. Consequently, when a turbocharger is attached to a V-type ICE, the turbocharger is often mounted immediately adjacent to the valley, between the two cylinder banks of the engine block, to minimize the distance of travel of the exhaust stream, and to maximize use of the space between the banks. In this type of arrangement, the turbocharger is often surrounded by a protective jacket (commonly referred to as a valley shield or acoustic pad) in order to minimize undesirable radiation of heat and noise generated by engine components, such as, for example, the exhaust manifold, and also to maintain the energy content of the exhaust gases.

SUMMARY OF THE INVENTION

The valley shields of the present invention are operable to act as a noise, fluid, and heat barrier between an internal combustion engine assembly and engine components positioned on an opposing side of the valley shield. The valley shields of the present design offer, among other things, improved acoustic damping performance, increased thermal resiliency and protective capacity, and improved vibration attenuation. In addition, the present design also offers enhanced fluid drainage characteristics with minimal fluid absorption, while allowing for more efficient packaging and ease of installation of the valley shield during engine assembly.

According to one embodiment of the present invention, a valley shield is provided for use with an engine assembly. The engine assembly includes an engine block with first and second cylinder banks that define an interbank valley therebetween. The engine assembly also includes first and second cylinder heads respectively secured adjacent the first and second cylinder banks. The valley shield includes a unitary body with a base portion having first and second laterally spaced side portions extending angularly outward therefrom. The base portion of the valley shield is oriented proximate to the interbank valley, and is preferably contoured to define an air pocket therebetween. The unitary body is configured to pressably fit into place proximate to the interbank valley between the first and second cylinder banks. As such, the unitary body may be characterized by an absence of structure that is configured to receive a bolt, a fastener, a screw, or other means for attaching the unitary body to the engine block.

According to one aspect of the present invention, the two laterally spaced side portions extend from the base portion at a first angle, whereas the first and second cylinder banks extend from the engine block at a second angle that is less than the first angle, thereby providing the abovementioned press fit when the valley shield is properly mated with the engine block. In this instance, the unitary body is preferably locked into place adjacent the interbank valley by one or both of the first and second cylinder heads and the engine block sealing flange. Ideally, the valley shield is nestably positioned immediately adjacent to the interbank valley—i.e., there being no structure between the interbank valley and the valley shield.

According to another aspect of the present invention, the first and second laterally spaced side portions respectively include first and second flange portions extending laterally outward therefrom. The first and second flange portions are configured to directly engage with or abut against the outer perimeter of the interbank valley, and thereby provide an acoustic seal therebetween. For example, each of the flange portions has a laterally oriented outer edge with a substantially identical contour as that segment of the interbank valley perimeter respectively engaged by that particular outer edge. In addition, the first and second laterally spaced side portions preferably each consist of first, second and third wall members coplanar to and longitudinally displaced from one another. In this instance, the entire perimeter of the unitary body is preferably contoured to match the geometric configuration of the interbank valley and first and second cylinder banks.

According to yet another aspect of the present invention, the body of the valley shield includes a first layer made of a heat resistant material that is operable to reflect radiant heat, such as, but not limited to, aluminum or steel foil. In addition, the valley shield also includes a second layer made of an acoustic absorbing material having a first density, such as, but not limited to, compressed particle board. Also included is a third layer made of a fluid resistant material having a second density, such as, but not limited to, a melamine foam and powder composite.

According to yet another aspect of the present invention, the base portion includes one or more, preferably longitudinally displaced trough portions each defining one or more drain holes therethrough. Desirably, the diameter of each of the first and second drain holes is sufficiently sized to prevent surface tension from hindering fluid flow. In addition, each trough portion extends downwardly from the base portion to allow for gravitational evacuation of fluid therefrom. For example, the various trough drains holes are preferably positioned as the vertically lowest portion of the unitary body relative to the interbank valley. It is further preferred that each trough portion be configured to direct fluid away from the base portion, through the drain holes, towards a fluid drainage port provided in the interbank valley.

According to another embodiment of the present invention, a valley shield is provided for use with an internal combustion engine assembly. The engine assembly includes an engine block having first and second cylinder banks outwardly oriented with respect to one another such that they form an angle of less than 180 degrees, and thereby define a generally V-shaped interbank valley therebetween. The ICE assembly also includes first and second cylinder heads respectively secured adjacent the first and second cylinder banks.

The valley shield has a unitary body including a base portion with first and second laterally spaced side portions extending angularly outward therefrom. The unitary body is configured to pressably fit into place immediately adjacent the interbank valley between the first and second cylinder banks, and at least partially secure therein by one or more of the cylinder heads. Each laterally spaced side portion includes a respective flange portion that extends laterally outward therefrom. Each flange portion is configured to directly engage with a perimeter of the interbank valley to provide an acoustic seal therebetween. The base portion includes first and second longitudinally displaced trough portions each defining one or more drain holes therethrough. The trough portions are configured to allow for gravitational evacuation of fluid therefrom.

According to yet another embodiment of the present invention, an internal combustion engine assembly is provided. The engine assembly includes an engine block having first and second cylinder banks outwardly oriented with respect to one another such that they form an angle of less than 180 degrees, and thereby define a generally V-shaped interbank valley therebetween. First and second cylinder heads are respectively secured adjacent the first and second cylinder banks. In addition, an exhaust manifold is integrally formed with one of the cylinder heads, and oriented adjacent to the interbank valley. A turbocharger, operable to receive exhaust gases from the exhaust manifold, is positioned proximate to the interbank valley. An exhaust gas recirculation system, including a flow control valve and a cooler unit with at least one coolant intake hose and least one coolant output hose, is at least partially nested within the interbank valley.

The internal combustion engine assembly also includes a valley shield interspersed between the interbank valley and the turbocharger or the exhaust gas recirculation system. The valley shield is contoured to define an air pocket between the interbank valley and the turbocharger or the exhaust gas recirculation system. The valley shield has a unitary body including a base portion with first and second laterally spaced side portions extending angularly outward therefrom. The unitary body is configured to pressably fit into place immediately adjacent the interbank valley between the first and second cylinder banks, and be at least partially secured therein by one or both of the cylinder heads. The first and second laterally spaced side portions respectively include first and second flange portions extending laterally outward therefrom. Each flange portion is configured to directly engage with the perimeter of the interbank valley to thereby provide an acoustic seal therebetween. The base portion includes one or more trough portions, each defining at least one drain hole therethrough. Each trough portion extends downwardly from the base portion to allow for gravitational evacuation of fluid therefrom.

The above features and advantages, and other features and advantages of the present invention will be readily apparent from the following detailed description of the preferred embodiments and best modes for carrying out the present invention when taken in connection with the accompanying drawings and appended claims.

DESCRIPTION OF THE PREFERRED EMBODIMENTS

Figure 1:
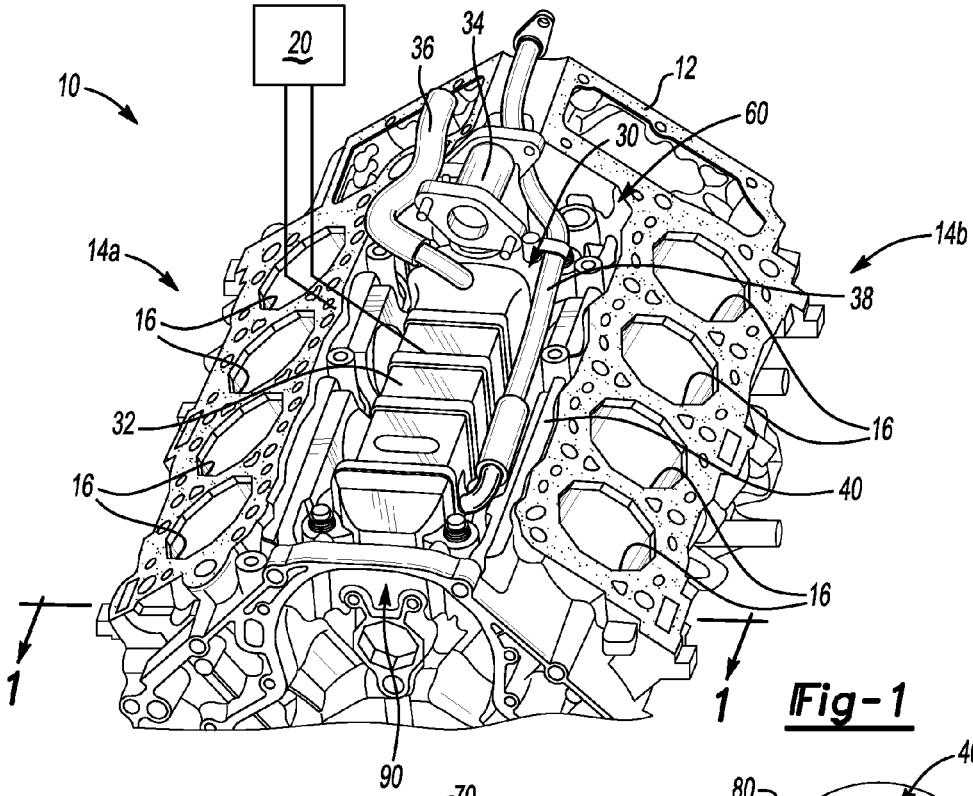
FIG. 1 is a schematic perspective illustration of a portion of an exemplary internal combustion engine assembly having nested therein a valley shield in accordance with a preferred embodiment of the present invention.

Referring to the Figures, wherein like reference numbers refer to the same or similar components throughout the several views, there is shown in FIG. 1 an internal combustion engine assembly, presented herein in an exemplary embodiment as a four-stroke cycle, turbocharged and intercooled diesel engine, indicated generally at 10. The engine assembly 10 includes a turbocharger device 20 and exhaust gas recirculation (EGR) system 30 in operative communication therewith. Notably, the engine 10, turbocharger 20, and EGR system 30 shown in FIG. 1 have been greatly simplified, it being understood that further information regarding such systems may be found in the prior art. Furthermore, it should be readily understood that FIG. 1 is merely a representative application by which the present invention may be practiced. As such, the present invention is by no means limited to the particular engine configuration of FIG. 1. Finally, the drawings presented herein, i.e., FIGS. 1 through 3B, are not to scale and are provided purely for instructional purposes. Thus, the particular dimensions of the drawings presented herein are not to be considered limiting.

The engine assembly 10 includes an engine block 12 with a generally "V-type" configuration. In a V-type configuration, the engine block 12 includes a left and a right bank of cylinder bores, referred to hereinafter as first and second cylinder banks 14A and 14B, respectively, outwardly oriented with respect to one another at an included angle (such as second angle 72 of FIG. 3A) of less than 180 degrees to define an interbank valley 60 therebetween. Each of the first and second cylinder banks 14A, 14B defines one or more piston cylinder bores, identified throughout the FIGS. by reference numeral 16. To this regard, the internal combustion engine 10 may operate, for example, in a compression ignited or spark ignited combustion mode.

The turbocharger, which is depicted schematically herein at 20, is in fluid communication with both the engine block 12 and the EGR system 30. The turbocharger 20 includes a turbine portion (not shown) with a turbine housing in fluid communication with the engine exhaust manifold (not shown). The turbine housing receives exhaust gases from the exhaust manifold, and redirects the exhaust stream to a compressor housing (not shown) for condensing ambient air therein. The compressed air is subsequently introduced to the intake manifold to increase the volumetric efficiency of the engine assembly 10. The engine assembly 10 may incorporate a single turbocharger device (as discussed herein), twin turbochargers, or staged turbochargers, without departing from the intended scope of the present invention.

The EGR system 30 is partially depicted in FIG. 1 by an EGR cooler 32 and EGR flow control valve 34. The EGR flow control valve 34 is upstream of the EGR cooler 32, and adapted to control the amount of exhaust gas that is recycled through the engine assembly 10. The EGR cooler 32 is operable to receive coolant (not shown) from a coolant intake hose 36 to cool exhaust gas circulating proximal thereto (e.g., through convective heat transfer). The coolant is thereafter evacuated from the EGR cooler 32 through a coolant output hose 38 to a heat sink (not shown) in order to be recycled through the engine assembly 10. The EGR system 30 is operable to selectively recirculate a predetermined volume of the exhaust gas produced by the engine assembly 10 back to the piston cylinder bores 16.

Figure 3A:
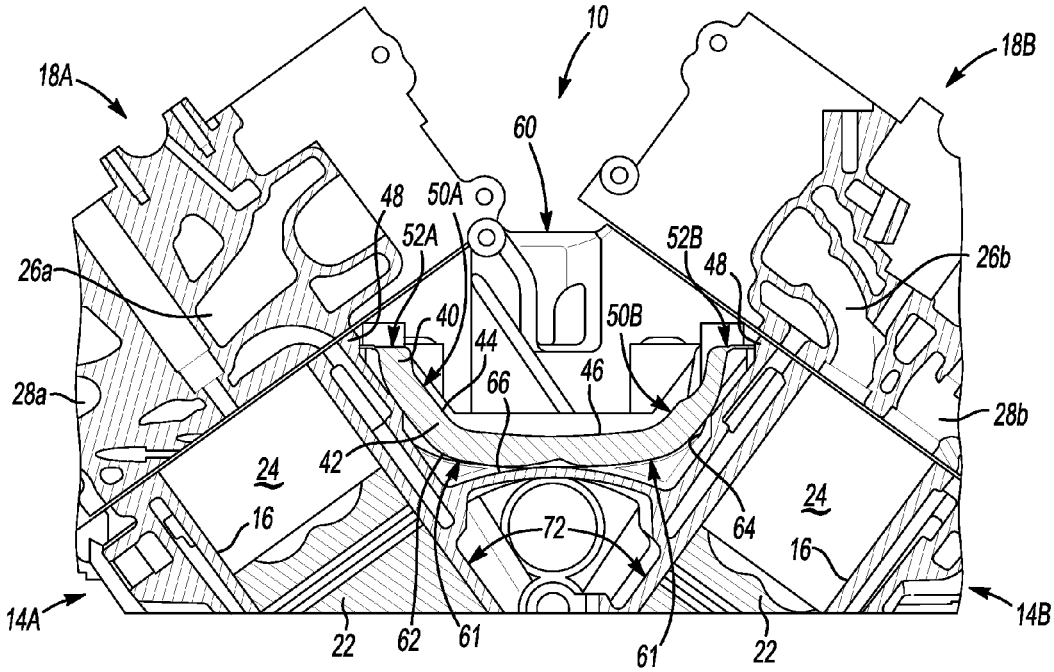
FIG. 3A is a front cross-sectional view of the internal combustion engine assembly taken along line 1-1 of FIG. 1.

Looking now to FIG. 3A, first and second cylinder heads 18A and 18B, respectively, are mounted to a respective one of the first and second cylinder banks 14A, 14B. A piston 22 is reciprocally positioned within each piston cylinder bore 16. A variable volume combustion chamber 24 is defined between the pistons 22 and cylinder heads 18A, 18B. Each of the first and second cylinder heads 18A, 18B define a plurality of exhaust ports 26A, 26B, respectively, through which exhaust gases or products of combustion (e.g., nitrogen oxide, nitrogen dioxide, etc.) are selectively evacuated from the respective cylinder bore 16. The exhaust ports 26A, 26B communicate exhaust gases to a respective integral exhaust manifold (not shown), also defined within the first and second cylinder heads 18A, 18B. Intake manifolds (not shown) distribute air to one of a plurality of intake runners (not shown), each of which is in fluid communication with a respective one of a plurality of intake ports, such as first and second intake ports 28A and 28B, respectively, defined by the first and second cylinder heads 18A, 18B. The intake ports 28A, 28B are adapted to selectively introduce air into one of the plurality of piston cylinder bores 16 where it, along with a fuel charge, is subsequently combusted in a known fashion.

As shown in FIG. 3A, the V-shaped interbank valley 60 includes first and second laterally opposed bank portions 62 and 64, respectively, and an intermediate, bottom portion 66 therebetween. The first and second integral exhaust ports 26A, 26B are positioned with respect to the cylinder block 12 such that they discharge exhaust gases in an inboard configuration. Specifically, the first and second integral exhaust ports 26A, 26B are substantially adjacent to an inboard region of the engine assembly 10, proximal to the generally interbank valley 60. The inboard discharge configuration is beneficial in that the packaging requirement of the engine 10 may be reduced. However, the first and second exhaust ports 26A, 26B and first and second intake ports 28A, 28B may operate in any orientation within the general area defined by the cavity 60 without departing from the scope of the present invention.

According to the embodiment of FIG. 1, a valley shield 40, also referred to herein as a valley barrier or acoustic pad, is shown nestably positioned substantially inside the interbank valley 60. As best seen in FIGS. 2 and 3B, the valley shield 40 includes a unitary body 42, elongated in a longitudinal direction of the engine assembly 10. Ideally, the unitary body 42 is a one-piece member. However, it is also within the scope of the claimed invention that the unitary body 42 be fabricated as multiple segments.

Referring to FIG. 2, the unitary body 42 includes a base portion 44 with a recessed stratum 46. First and second laterally spaced side portions 50A and 50B, respectively, extend angularly outward from the base portion 44 in a generally obtuse oblique manner. The first laterally spaced side portion 50A includes first, second and third wall members 54A, 56A and 58A, respectively, which are coplanar with and longitudinally displaced from one another. Similarly, the second laterally spaced side portion 50B includes first, second and third wall members 54B, 56B and 58B, respectively, which are coplanar with and longitudinally displaced from one another. The base portion 44 of the valley shield 40 is oriented immediately adjacent to the bottom portion 66 of the interbank valley 60—i.e., there being no structure between the valley shield 40 and the interbank valley 60, and is contoured to define an air pocket 61 therebetween.

The first and second laterally spaced side portions 50A, 50B include first and second flange portions 52A and 52B, respectively, extending laterally outward therefrom. As best seen in FIGS. 3A and 3B, the first and second flange portions 52A, 52B are configured to directly engage (e.g., come into hard contact) with an outer perimeter 68 of the interbank valley 60 to provide an acoustic seal therebetween. More specifically, each of the first and second flange portions 52A, 52B has an outer edge with substantially the same contour (i.e., geometrically coextensive) as that portion of the perimeter 68 of the interbank valley 60 respectively engaged by that flange, as best seen in FIG. 3B. Ideally, the perimeter 43 of the entire unitary body 42 is contoured or shaped to match the geometric configuration of the interbank valley 60 and first and second cylinder banks 18A, 18B.

Figure 2A:
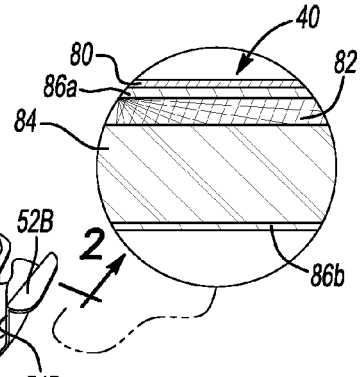
FIG. 2A is a cross-sectional view of a portion of the valley shield taken along line 2-2 of FIG. 2.
Figure 2:
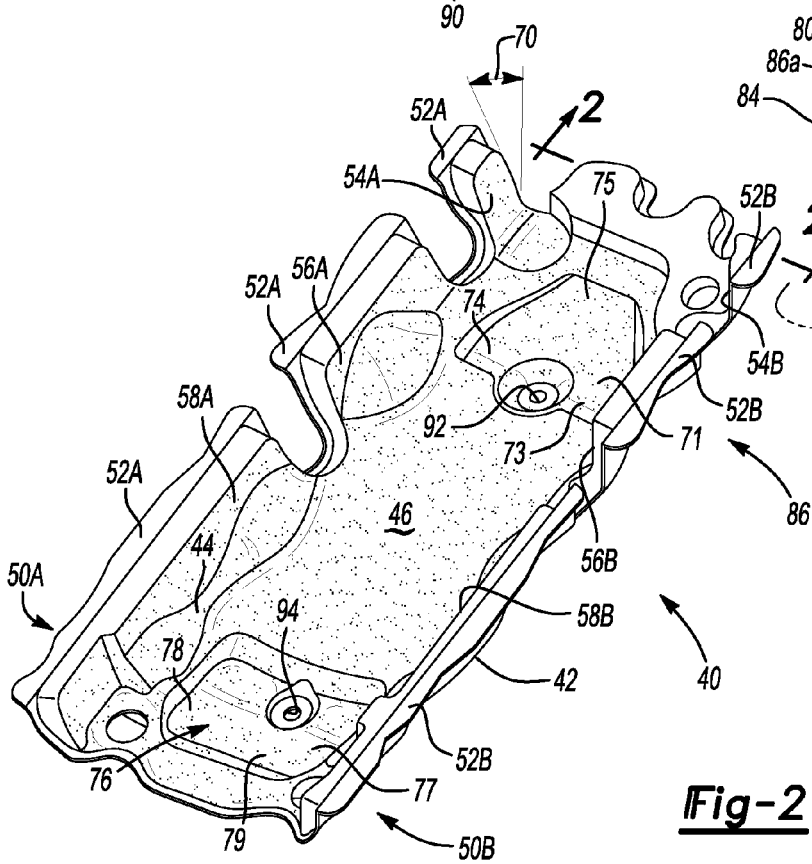
FIG. 2 is a perspective illustration of the valley shield of FIG. 1.
Figure 3B:
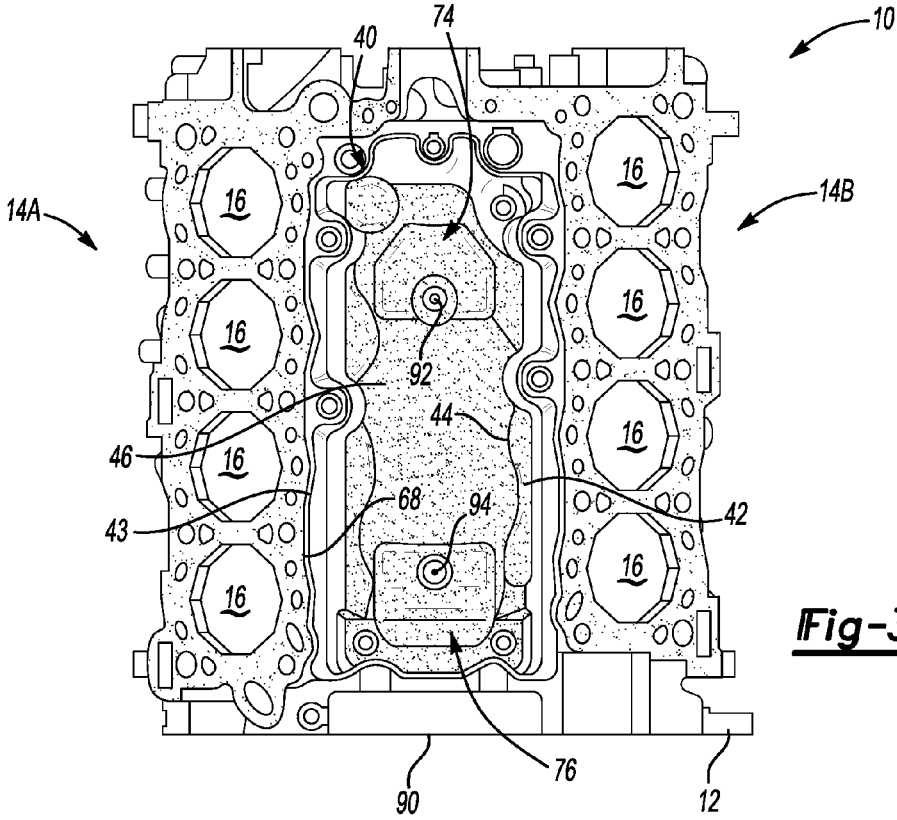
FIG. 3B is a plan perspective illustration of the internal combustion engine assembly of FIG. 1 with certain components removed to more clearly illustrate the perimeter sealing, nest fit between the valley shield and engine block.

Looking now to FIG. 2A, a cross-sectional view of a portion of the valley shield 40 is provided, taken along line 2-2 of FIG. 2. The valley shield 40 is a multi-layered composite or laminate structure, including first, second, and third layers 80, 82 and 84, respectively, and a fluid resistant (e.g., non-absorbent) scrim jacket 86A-B. As shown in FIG. 2A, the first layer 80 is intended as the top most layer of the unitary body 42 (i.e., most distal layer relative to the engine block 12). The first layer 80 is a fluid resistant, reflective material, such as, but not limited to, aluminum or steel foil, operable to deflect radiant heat produced by the EGR cooler 32 and, through the addition of optional micro-perforations (not shown), for enhanced acoustic absorption. The first layer 80 is secured, adhered, or attached, e.g., via an adhesive (not shown), to an upper portion of the fluid resistant scrim jacket 86A-B, referred to hereinafter as the first scrim layer 86A. The second and third layers 82, 84 are encased by or sandwiched within the fluid resistant scrim jacket 86A-B. In other words, the second and third layers 82, 84 are disposed between the first scrim layer 86A, and a lower portion of the fluid resistant scrim jacket 86A-B, referred to hereinafter as the second scrim layer 86B, which is intended as the bottom most, engine-side layer. The second layer 82 is made of a first material having a first density, whereas the third layer 84 is made of a second material having a second density. More specifically, the second layer 82 is intended to be a high density, acoustic barrier, fabricated from, for example, but not limited to, compressed particle board. Contrastingly, the third layer 84 is intended to be a lower density, fluid resistant layer, fabricated from, for example, but not limited to, a melamine foam impregnated with a talcum based powder. Recognizably, FIG. 2A is an illustration provided herein for explanation and clarification purposes and is in no way intended as limiting.

Looking now at FIG. 3A, the unitary body 42 is nestably positioned proximate to the interbank valley 60, adjacent to bank portions 62 and 64 and bottom portion 66, between the first and second cylinder banks 14A, 14B and the first and second cylinder heads 18A, 18B. The unitary body 42 is operatively configured to pressably fit or "snap" into place adjacent the interbank valley 60 between the first and second cylinder banks 14A, 14B, and be securably locked therein by the first and second cylinder heads 18A, 18B and the engine block sealing flange 48. For example, the first and second laterally spaced side portions 50A, 50B extend from the base portion 44 of the unitary body 42 at a first angle 70 (FIG. 2), whereas the first and second cylinder banks 14A, 14B extend from the engine block 12 at a second angle 72 (FIG. 3A). The first angle 70 is greater than the second angle 72 such that the valley shield 40 is slightly wider than the interbank valley 60. Once pressed into the interbank valley 60, the extra width and elastic nature of the unitary body 42 will tend to push the valley shield 40 upward against the first and second cylinder heads 18A, 18B and the engine block sealing flange 48, thus retaining the valley shield in its nested position therebetween. Accordingly, the unitary body 42 may be characterized by an absence of structure configured to receive any means solely intended to fasten the valley shield 40 to the engine block 12, such as, by way of example, bolts, bosses, fasteners, and screws (none of which are depicted herein). Additional benefits of this particular configuration is that upwardly biasing motion created by the extra width and elastic nature of the unitary body 42 is to enlarge the size (i.e., volume) of the air pocket 61, providing for better acoustic absorption, and minimizing hard contact area with the engine block 12, thereby reducing or eliminating conductive heat transfer therebetween. Of paramount importance, a valley shield 40 of the present design may be readily installed early in the engine build process with minimal labor and effort, as the present configuration will allow the valley shield 40 to be retained during any subsequent engine build operations.

Turning back to FIG. 2, the recessed stratum 46 of the body base portion 44 defines one or more advanced "drainback" features, defined herein by first and second longitudinally displaced trough portions 74 and 76, respectively. The first trough portion 74 includes a first stepped surface 71 connected to the recessed stratum 46 via first peripheral trough wall 73 and first inclined surface 75. Similarly, the second trough portion 76 includes a second stepped surface 77 connected to the recessed stratum 46 via second peripheral trough wall 78 and second inclined surface 79. The one or more advanced "drainback" features, i.e., trough portions 74, 76, each respectively defines one or more drainage holes, such as first and second drain holes 92, 94 of FIG. 2. The number of drainage holes, and diameter of each drainage hole, such as first and second drain holes 92, 94, should be properly configured to maintain proper acoustic sealing. Contrastingly, the diameter of each drainage hole, such as first and second drain holes 92, 94, is sufficiently sized to prevent surface tension from hindering fluid flow during evacuation.

Pooling of fluid (not shown) in the valley shield 40 due to the "tub" shape of the unitary body 42 is minimized or eliminated through the present design. Specifically, an oil drainage port or hole 90 is formed in the engine block 12, preferably at a rearward end of the interbank valley 60, through the bottom portion 66, such that any oil collected in the interbank valley 60 can be evacuated therefrom. The first and second trough portions 74, 76 are each geometrically configured, e.g., via the peripheral trough wall 73, 78 and inclined surface 75, 79, to direct fluid away from the recessed stratum 46 towards the fluid drainage port 90. The first and second trough portions 74, 76 are also configured to allow for gravitational evacuation of fluid therefrom. For example, the first and second trough portions 74, 76 extend downward from the base portion 44 of the unitary body 40 such that of the first and second drains holes 92, 94 are positioned as the vertically lowest portion of the unitary body 42 relative to the interbank valley 60.

While the best modes for carrying out the invention have been described in detail, those familiar with the art to which this invention relates will recognize various alternative designs and embodiments for practicing the invention within the scope of the appended claims.

The invention claimed is:

1. A valley shield for use with an engine assembly including an engine block with first and second cylinder banks defining an interbank valley therebetween, the valley shield comprising:

a unitary body including a base portion with first and second laterally spaced side portions extending angularly outward therefrom;

wherein the unitary body is operatively configured to pressably fit into place proximate to the interbank valley between the first and second cylinder banks.

2. The valley shield of claim 1, wherein the first and second laterally spaced side portions extend from the base portion at a first angle and the first and second cylinder banks extend from the engine block at a second angle, wherein the first angle is greater than the second angle to thereby provide the press fit.

3. The valley shield of claim 2, wherein the engine assembly also includes first and second cylinder heads respectively secured adjacent the first and second cylinder banks, the unitary body being at least partially secured into place proximate to the interbank valley between the first and second cylinder banks by at least one of the first and second cylinder heads.

4. The valley shield of claim 3, wherein the unitary body is characterized by an absence of structure configured to receive any of a bolt, a fastener, a boss, and a screw.

5. The valley shield of claim 1, wherein the first and second laterally spaced side portions respectively include first and second flange portions extending laterally outward therefrom, the first and second flange portions being configured to operatively engage with a perimeter of the interbank valley and thereby provide an acoustic seal therebetween.

6. The valley shield of claim 5, wherein each of the first and second flange portions has a laterally oriented outer edge with substantially the same contour as that portion of the perimeter of the interbank valley respectively engaged.

7. The valley shield of claim 6, wherein each of the first and second laterally spaced side portions includes first, second and third wall members coplanar to and longitudinally displaced from one another.

8. The valley shield of claim 1, wherein the unitary body further includes at least one layer of fluid resistant material, at least one layer of heat resistant material, and at least one layer of acoustic absorbing material.

9. The valley shield of claim 8, wherein the at least one fluid resistant layer is made from a melamine foam and powder composite, the at least one heat resistant layer is made of a metallic foil material, and the at least one acoustic absorbing layer is made from compressed particle board.

10. The valley shield of claim 1, wherein the base portion is contoured to define an air pocket between the unitary body and the interbank valley.

11. The valley shield of claim 1, wherein the unitary body is configured to nestably position immediately adjacent to the interbank valley.

12. The valley shield of claim 1, wherein the base portion includes at least one trough portion defining at least one drain hole therethrough.

13. The valley shield of claim 12, wherein the at least one trough portion extends downwardly from the base portion to allow for gravitational evacuation of fluid therefrom.

14. The valley shield of claim 13, wherein the at least one drain hole is operatively positioned as the vertically lowest portion of the unitary body relative to the interbank valley.

15. The valley shield of claim 14, wherein the at least one trough portion is operatively configured to direct fluid away from the base portion, through the at least one drain hole, towards a fluid drainage port defined in the interbank valley.

16. A valley shield for use with an internal combustion engine assembly including an engine block having first and second cylinder banks outwardly oriented with respect to one another such that they form an angle of less than 180 degrees and define a generally V-shaped interbank valley therebetween, and first and second cylinder heads respectively secured adjacent the first and second cylinder banks, comprising:

a unitary body including a base portion with first and second laterally spaced side portions extending angularly outward therefrom;

wherein the unitary body is operatively configured to pressably fit into place immediately adjacent the interbank valley between the first and second cylinder banks and be at least partially secured therein by at least one of the cylinder heads;

wherein the first and second laterally spaced side portions respectively include first and second flange portions extending laterally outward therefrom and configured to directly engage with a perimeter of the interbank valley to thereby provide an acoustic seal therebetween; and wherein the base portion includes first and second longitudinally displaced trough portions each defining at least one drain hole therethrough and configured to allow for gravitational evacuation of fluid therefrom.

17. The valley shield of claim 16, wherein the unitary body further includes at least one layer of fluid resistant material, at least one layer of heat resistant material, and at least one layer of acoustic absorbing material.

18. The valley shield of claim 17, wherein each of the first and second flange portions has a laterally oriented outer edge with substantially the same contour as that portion of the perimeter of the interbank valley respectively engaged.

19. The valley shield of claim 17, wherein the first and second through portions extend downwardly from the base portion such that the at least one drain hole is operatively positioned as the vertically lowest portion of the unitary body relative to the interbank valley.

20. An internal combustion engine assembly comprising:

an engine block having first and second cylinder banks outwardly oriented with respect to one another such that they form an angle of less than 180 degrees and thereby define a generally V-shaped interbank valley therebetween;

first and second cylinder heads respectively secured adjacent the first and second cylinder banks;

an exhaust manifold formed integrally with at least one of the first and second cylinder heads and oriented adjacent to the interbank valley;

a turbocharger disposed proximate to the interbank valley and operable to receive exhaust gases from the exhaust manifold;

an exhaust gas recirculation system including a flow control valve and a cooler unit with at least one coolant intake hose and least one coolant output hose, the exhaust gas recirculation system at least partially nested within the interbank valley; and a valley shield having a unitary body including a base portion with first and second laterally spaced side portions extending angularly outward therefrom, the valley shield being operatively disposed between the interbank valley and at least one of the turbocharger and the exhaust gas recirculation system and contoured to define an air pocket therebetween;

wherein the unitary body is operatively configured to pressably fit into place immediately adjacent the interbank valley between the first and second cylinder banks and be at least partially secured therein by at least one of the cylinder heads;

wherein the first and second laterally spaced side portions respectively include first and second flange portions extending laterally outward therefrom and configured to directly engage with a perimeter of the interbank valley to thereby provide an acoustic seal therebetween; and wherein the base portion includes at least one trough portion defining at least one drain hole therethrough, the at least one trough portion extending downwardly from the base portion to allow for gravitational evacuation of fluid therefrom.

* * * * *